United States Patent [19]

Townsend et al.

[11] Patent Number: 4,730,628

[45] Date of Patent: Mar. 15, 1988

[54] CIGARETTE RODS HAVING SEGMENTED SECTIONS

[75] Inventors: David E. Townsend; Thomas A. Perfetti, both of Winston-Salem, N.C.

[73] Assignee: R. J. Reynolds Tobacco Company, Winston-Salem, N.C.

[21] Appl. No.: 887,463

[22] Filed: Jul. 21, 1986

[51] Int. Cl.[4] ..... A24D 1/00; A24B 15/00

[52] U.S. Cl. ..... 131/364; 131/360; 131/365

[58] Field of Search ..... 131/360, 361, 364, 365, 131/290, 335, 34.1, 34.2, 365, 84.1, 84.3, 84.4

[56] References Cited

U.S. PATENT DOCUMENTS

| | | | |
|---|---|---|---|
| 3,368,566 | 2/1968 | Avedikian | 131/341 |
| 3,604,429 | 9/1971 | De Witt | 131/84.1 |
| 3,759,267 | 9/1973 | Thornton . | |
| 3,880,171 | 4/1975 | Naylor | 131/84.1 |
| 3,902,504 | 9/1975 | Owens, Jr. et al. | 131/360 |
| 3,913,590 | 10/1975 | Sway | 131/360 |
| 4,009,722 | 3/1977 | Wahle et al. | 131/84.4 |
| 4,146,040 | 3/1979 | Cohn . | |
| 4,328,817 | 5/1982 | Naylor et al. | 131/360 |
| 4,434,804 | 3/1984 | Bott et al. | 131/364 |
| 4,453,553 | 6/1984 | Cohn . | |
| 4,516,585 | 5/1985 | Pinkham | 131/84.1 |
| 4,595,024 | 6/1986 | Greene et al. . | |

*Primary Examiner*—V. Millin
*Assistant Examiner*—H. Macly

[57] ABSTRACT

Cigarette rods include four segments of smokable material. First and second segments are positioned at the extreme ends of the rod. The first segment is positioned at the end of the rod to be lit. A third segment is positioned adjacent the first segment, and a fourth segment is positioned adjacent the second segment. The density of the third segment is greater than the fourth segment. The first and second segments can be "dense ends" or "loose ends" relative to the respective adjacent segments. The cigarette rods have a relatively uniform burn rate provided by treatment of the wrapping material of the rod with burn rate suppressants and burn rate accelerators in the positions thereof which overlie the third and fourth segments, respectively.

38 Claims, 3 Drawing Figures

CIGARETTE RODS HAVING SEGMENTED SECTIONS

BACKGROUND OF THE INVENTION

This invention relates to smoking articles such as cigarettes.

In the manufacture of smoking articles such as cigarettes, design parameters can be varied in order to control properties thereof. For example, properties such as the tobacco smoke delivery profile can be varied in order to control the composition of the tobacco smoke during use of the cigarette. Typical parameters which are varied include the choice of tobacco additives and/or cigarette paper additives, the permeability of the cigarette paper, the composition of the tobacco or blend of smokable materials, the strand width of the smokable material, the filling capacity of the smokable material, the properties of the filter element which is employed, and the like.

An ability to change the smoke delivery profile of the cigarette allows the manufacturer to provide cigarettes exhibiting varying perceived sensory characteristics. Such characteristics can be varied from cigarette to cigarette and/or from puff to puff during use of a particular cigarette.

One particularly useful method for providing cigarettes having unique smoke delivery profiles involves manufacturing cigarette rods having various segments of smokable material wherein each of the various segments are defined in terms of their densities. For example, a cigarette rod can have a region of smokable material of substantially uniform but relatively high density extending along a portion of the length of the rod towards the mouthend or filter end thereof, and a region of smokable material of substantially uniform but relatively low density extending along a portion of the length of the rod towards the fire end or lit end thereof. Although such a cigarette rod can provide a unique puff-by-puff delivery to the smoker, the burn characteristics thereof may not be as controllable as may be desirable. For example, a cigarette having a low density region of smokable material towards the fire end thereof may tend to burn initially at a relatively fast rate, while the dense region of smokable material positioned towards the mouthend or filter end thereof may tend to burn at a relatively slow rate. Thus, such a cigarette may tend to burn down relatively fast and then relatively slow, during the time that the cigarette is smoked.

It would be highly desirable to provide a cigarette rod which is capable of being manufactured such that the smoke delivery profile and the burn rate thereof can be readily controlled.

SUMMARY OF THE INVENTION

This invention relates to a rod suitable for the manufacture of a cigarette. The rod comprises filler material contained in wrapping material, and the two ends of the rod are open to expose the filler material. The filler material forms at least four segments within the rod and each segment is defined by its density. A first segment is disposed at one extreme end of the rod. A second segment is disposed at the opposite end of the rod. A third segment is disposed adjacent to the first segment. A fourth segment is disposed adjacent to the second segment. Each of the third segment and fourth segment has a substantially uniform density in the region along the length of the rod and across the rod in a plane perpendicular to the longitudinal axis thereof. The density of the fourth segment is less than that of the third segment such that the density differential therebetween is at least about 15 percent. The wrapping material has (i) a relatively high burn rate capability at least in a substantial region thereof which overlies the third segment, and (ii) a relatively low burn rate capability at least in a substantial region thereof which overlies the fourth segment.

In another aspect, this invention relates to a filter cigarette comprising the aforementioned rod and a filter element (i) axially aligned therewith at one end thereof, and (ii) fixedly secured thereto.

This invention provides for the efficient and effective preparation of cigarette rods having relatively uniform burn rates over the total length of the rod. Of particular interest is the ability to provide a cigarette having a smoke delivery profile such that the user perceives a relatively constant nicotine delivery during use thereof. For example, smooth smoking cigarettes can be provided. Altenatively, cigarettes can be provided exhibiting smoking characteristics which provide the perceived impression of low or high strength for a particular level of delivered particulate matter. Cigarettes of this invention do not burn undesirably slowly through the dense third segment of the rod, while not burning undesirably quickly through the less dense fourth segment.

DETAILED DESCRIPTION OF THE EMBODIMENTS

Figure 1:
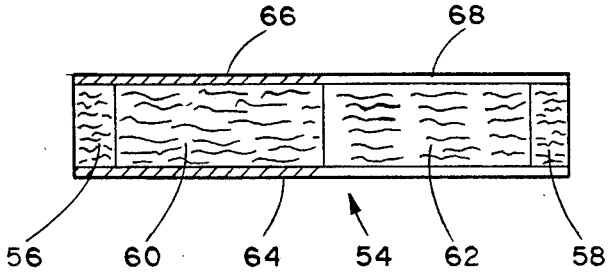
FIG. 1 is a diagrammatic cross sectional illustration of a cigarette rod showing the four segments of filler material.

An embodiment of this invention shown in FIG. 1 is a generally cylindrical rod 54 having four segments of filler material. Typically, the length of the rod ranges from about 55 mm to about 85 mm, and the circumference of the rod ranges from about 20 mm to about 26 mm. The first segment 56 is positioned at one end of the rod. Second segment 58 is positioned at the opposite end of the rod. Third segment 60 is positioned adjacent the first segment. Fourth segment 62 is positioned adjacent the second segment. The segments each are aligned in an abutting, end-to-end relationship. The segments are contained in circumscribing wrapping material 64 which is manufactured into a tube-like shape enclosing the segments and thereby forming the rod. The ends of the rod are open to expose the filler material.

The wrapping material 64 can be any conventional cigarette wrapping paper which can be manufactured, processed or treated to have region 66 of relatively high burn rate capability and region 68 of relatively low burn rate capability. As shown in FIG. 1, region 66 of relatively high burn rate capability extends over each of the first segment 56 and third segment 60; while region 68 of relatively low burn rate capability extends over each of second segment 58 and fourth segment 62. The region 66 of relatively high burn rate capability can be provided by processing or treating a portion of a conventional cigarette paper wrap with burn rate accelerators, while the region 68 of relatively low burn rate capability can be provided by leaving a portion of the wrap essentially unprocessed or untreated with burn accelerators. Alternatively, the region 68 of relatively low burn rate capability can be provided by processing or treating a portion of a conventional cigarette paper wrap with burn rate suppressants, while region 66 of relatively high burn rate capability can be provided by leaving a portion of the wrap essentially unprocessed or untreated with burn suppressants. Additionally, region 66 of relatively high burn rate capability can be provided by processing or treating a portion of a conventional cigarette paper wrap with a burn rate accelerator, while region 68 of relatively low burn rate capability can be provided by processing or treating a portion of the same conventional cigarette paper wrap with a burn rate suppressant.

Examples of burn rate accelerators include compounds such as sodium citrate, potassium citrate, potassium chlorate, sodium perchlorate, ammonium perchlorate, sodium bromate, as well as potassium nitrate, sodium nitrite, ammonium sulfate, sodium tartrate, ammonium acetate, potassium malate, potassium phosphate, sodium formate, and the like. Preferably, burn rate accelerators are employed in amounts sufficient to increase the burn rate of the rod in the region thereof having a relatively high density segment, while not providing undesirable characteristics such as adverse taste to the smoking article. Typically, the amount of burn rate accelerator ranges from about 0.5 percent to about 10 percent, more preferably, from 1 percent to about 5 percent, based on the total weight of the wrap in the treated section. Generally, the amount of burn rate accelerator employed in the manufacture of a particular smoking article depends upon factors such as the burn rate acceleration properties of the particular burn rate accelerator, the density of the segment, the appearance and properties of the coal and ash, and the like. For example, segments of relatively great density can be enveloped by wrapping material which is treated with relatively great amounts of burn rate accelerator.

Burn rate accelerators can be applied to the wrapping material using a variety of techniques. For example, an aqueous solution of burn rate accelerator can be applied to the desired region of the wrapping material using a roller application, a conventional printing technique, or the like. The burn rate accelerator can be applied to the inner surface or outer surface of the wrap. If desired, a convoluted web of cigarette paper wrap can be treated so as to have the desired alternating regions having burn rate accelerator and alternating regions having no burn rate accelerator.

Examples of burn rate suppressants include ammonium chloride, sodium bromide, sodium molybdates, sodium vanadates, film forming materials such as starches and pectins, and the like. Preferably, burn rate suppressants are employed in amounts sufficient to decrease the burn rate of the rod in the region thereof having a relatively low density segment, while not providing undesirably characteristics such as adverse taste to the smoking article. Typically, the amount of burn rate suppressant ranges from about 1 percent to about 15 percent, based on the total weight of the wrap in the treated section. Generally, the amount of burn rate suppressant employed in the manufacture of a particular smoking article depends upon factors such as the burn rate suppression properties of the particular burn rate suppressant, the density of the segment, appearance and properties of the coal and ash, and the like. For example, segments of relatively low density can be enveloped by wrapping material which is treated with relatively great amounts of burn rate suppressant.

Burn rate suppressants can be applied to the wrapping material using a variety of techniques. For example, an aqueous solution of burn rate suppressant can be applied to the desired region of the wrapping material using a roller application, a conventional printing technique, or the like. The burn rate suppressant can be applied to the inner surface or outer surface of the wrap. If desired, a convoluted web of cigarette paper wrap can be treated so as to have the desired alternating regions having burn rate suppressant and alternating regions having no burn rate suppressant. Additionally, a convoluted web of cigarette paper wrap can be treated so as to have alternating regions having burn rate suppressant and alternating regions having burn rate accelerator.

For good, consistent burn characteristics of the rod, it is most desirable that each of the regions of relatively low burn rate capability and relatively high burn capability extend completely around the rod in a relatively uniform manner such that the respective regions have relatively constant characteristics about the periphery of the rod (as measured in a plane perpendicular to the longitudinal axis of the rod). In addition, it is highly desirable that the burn rate suppressant extend along the total region of the wrapping material which overlies the fourth segment; and that the burn rate accelerator extend along the total region of the wrapping material which overlies the third segment. Furthermore, for the embodiment shown in FIG. 1, it is most desirable that the burn rate suppressant extend along the total region of the wrapping material which overlies both the second and fourth segments; and that the burn rate accelerator extend along the total region of the wrapping material which overlies both the first and third segments.

Figure 2:
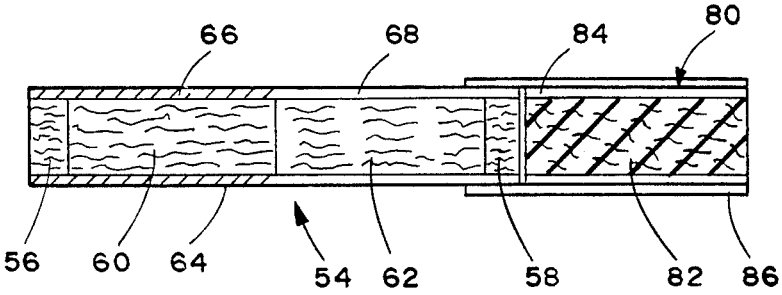
FIGS. 2 and 3 are diagrammatic cross sectional illustrations of a cigarette showing the rod of FIG. 1 and a filter element attached at one end thereof.
Figure 3:
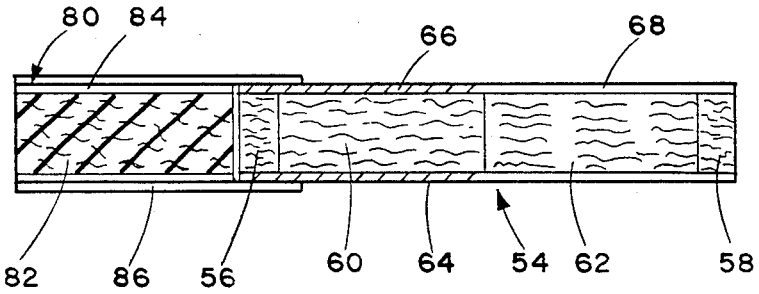

For the embodiments shown in FIGS. 2 and 3, the smoking article further comprises filter plug 80 positioned adjacent to one end of rod 54 such that the filter plug is axially aligned with the rod in an end-to-end relation. For the embodiment shown in FIG. 2, the filter plug is positioned adjacent second segment 58 of rod 54. For the embodiment shown in FIG. 3, the filter plug is positioned adjacent first segment 56 of rod 54. For both embodiments, filter plug 80 has a substantially cylindrical shape, and the diameter thereof is substantially equal to the diameter of the rod. Preferably, the filter plug abuts or substantially abuts the rod. The ends of the filter plug are open to permit the passage of air and smoke therethrough. The filter plug includes filter element 82 which is overwrapped along the longitudinally extending surface thereof with circumscribing wrap material 84. The filter element can be constructed from cellulose acetate, or other suitable material. The wrap material can be air impermeable or air permeable material such as conventional paper plug wrap. However, if desired a nonwrapped cellulose acetate plug can be employed. Typically, the longitudinally extending length of the filter plug ranges from about 20 mm to about 35 mm. Filter plug 80 is attached to rod 54 by tipping material 86 which circumscribes both the filter plug and an adjacent region of the rod. The inner surface of the tipping material is fixedly secured to the outer surface of the filter plug and to the outer surface of the wrapping material of an adjacent region of the rod. The tipping material circumscribes the rod about a longitudinal length which can vary, but is typically that length sufficient to provide good attachment of the filter plug to the rod. Typically, the tipping material is either a conventional air impermeable or air permeable tipping material such as tipping paper. If desired, openings such as slits, holes or perforations in the substantially air impermeable tipping material and plug wrap can provide a means for air dilution of the smoking article.

Filler materials most preferably include smokable materials. Examples of smokable materials include tobacco materials such as cured or processed tobacco, reconstituted tobacco, tobacco substitute materials, blends thereof, and blends thereof with pyrolyzed or carbonized materials. Blends of tobaccos are particularly desirable. Filler materials can be employed in various manners. Typically, smokable material is employed as a charge of strands filler (i.e., as strands of material provided at from about 15 to about 70, most preferably at about 32 cuts per inch, and optionally treated with conventional additives such as flavorants and humectants).

The term "density" in referring to the individual segments of filler material means the weight of that segment of the rod per unit volume of the segment.

The term "segment" in referring to the filler contained within the rod means the portion of the rod extending longitudinally along the rod, and bounded by a plane at each end of the segment, which plane is positioned substantially transversely to the longitudinal axis of the rod. For a substantially cylindrical rod, the four required segments of filler material form four substantially cylindrical shaped segments within the tubular wrap, and are each aligned in an essentially abutting and end-to-end relationship. The boundary between each of the various substantially cylindrical shaped segments is relatively abrupt, providing a discrete, rapid transition of filler material therebetween. It is particularly desirable that at least the third and fourth segments be substantially cylindrical shaped and have a relatively abrupt boundary at the ends thereof. The densities of each of the first and second segments can vary throughout the respective segments.

The manner in which the density of each segment of filler material can be obtained can vary. Generally the manner of packing the filler material can affect the relative density of a particular segment. For example, filler material packed with a relatively low void volume can provide a relatively dense segment as compared to a segment provided by loosely packed filler material of similar composition. Alternatively, small size particles or thin strands of filler material can provide a relatively dense segment as compared to a segment provided by larger sized, similarly packed particles or strands of similar composition. In addition, additives (such as moisture) to the filler material of a particular segment can provide increased density to a segment as compared to a segment wherein similar filler material is untreated with additive. Furthermore, relatively dense filler material can provide a relatively dense segment as compared to a segment provided by similarly packed filler material of a lower density. For example, filler material can be selected from relatively dense tobacco material such as reconstituted tobacco, or a dense leaf such as oriental tobacco or the so called "Green River" tobaccos. Blends having large amounts of relatively dense tobacco materials can be employed. Alternatively, a low density tobacco material can be obtained from a less dense leaf such as low stalk flue cured tobacco or low stalk burley tobacco. Low density filler material also can be provided by employing foamed reconstituted tobacco, by employing expanded tobacco, by employing supercritically expanded tobacco, or other such materials. Blends having large amounts of low density tobacco materials can be employed. For example, the smokable material of the first and third segments can be volume expanded. However, if desired, the smokable material of the second and fourth segments can be volume expanded. It is understood that density differentials between the segments (particularly between the third and fourth segments) can be varied by varying one or more of the aforementioned methods for providing filler materials of various densities.

The density of the fourth segment is less than the density of the third segment. The density differential between the third and fourth segments is at least about 15, preferably at least about 20, more preferably at least about 30. Preferably the density differential extends up to about 270, more preferably up to about 130.

For purposes of this invention, the term "density differential" means one hundred times the quantity of the density ratio of the fourth segment to the third segment minus one.

The amount which each of the various segments extends longitudinally along the rod can vary. In one embodiment, the first segment can have a density greater than the adjacent third segment, while the second segment can have a density greater than the adjacent fourth segment (i.e., the first and second segments are so called "dense ends"). Typically, in such an embodiment, the combined longitudinal length of the first and third segments ranges from about 20 to about 80, preferably from 30 to about 70 percent of the total length of the rod, while the length of the first segment ranges from about 8 to about 20 percent of the total length of the rod; and the combined longitudinal length of the second and fourth segments ranges from about 20 to about 80, preferably about 30 to about 70 percent of the total length of the rod, while the length of the second segment ranges from about 8 to about 20 percent of the total length of the rod. In another embodiment, the first segment can have a density less than the adjacent third segment, while the second segment can have a density less than the adjacent fourth segment (i.e., the first and second segments are so called "loose ends"). Typically, in such an embodiment, the combined longitudinal length of the first and third segments ranges from about 20 to about 80, preferably about 30 to about 70 percent of the total length of the rod, while the length of the first segment ranges from about 2 to about 5 percent of the total length of the rod; and the combined longitudinal length of the second and fourth segments ranges from about 20 to about 80, preferably about 30 to about 70 percent of the total length of the rod, while the length of the second segment ranges from about 2 to about 5 percent of the total length of the rod. In yet another embodiment, the first segment can have a density greater than the density of the adjacent third segment, while the second segment can have a density less than the adjacent fourth segment (i.e., the first segment is a so called "dense end" and the second segment is a so called "loose end"). Typically, in such an embodiment, the combined longitudinal length of the first and third segments ranges from about 20 to about 80, preferably about 30 to about 70 percent of the total length of the rod, while the length of the first segment ranges from about 18 to about 42 percent of the total length of the rod; and the combined longitudinal length of the second and fourth segments range from about 20 to about 80, preferably about 30 to about 70 percent of the total length of the rod, while the length of the second segment ranges from about 2 to about 5 percent of the total length of the rod. In still another embodiment, the first segment can have a density less than the density of the adjacent third segment, while the second segment can have a density greater than the adjacent fourth segment (i.e., the first segment is a so called "loose end" and the second segment is a so called "dense end"). Typically, in such an embodiment, the combined longitudinal length of the first and third segments ranges from about 20 to about 80, preferably about 30 to about 70 percent of the total length of the rod, while the length of the first segment ranges from about 2 to about 5 percent of the total length of the rod; and the combined longitudinal length of the second and fourth segments range from about 20 to about 80, preferably about 30 to about 70 percent of the total length of the rod, while the length of the second segment ranges from about 18 to about 42 percent of the total length of the rod.

The amount of nicotine present in the various segments can vary. It is particularly desirable that the nicotine differential be employed between the third and fourth segments, although the relative nicotine content of each segment can be the same. By "relative nicotine content" is meant the amount of nicotine per weight of segment. For purposes of this invention, the term "nicotine differential" means one hundred times the quantity of the ratio of the relative nicotine content of the combined second and fourth segments to the relative nicotine content of the combined first and third segments minus one. It is possible for embodiments to exhibit a positive or negative nicotine differentials. Typically, the nicotine content of each of the segments can range from about 0.05 percent to about 12 percent, based on the total weight of the segment.

Cigarette rods of this invention can be readily provided using the equipment which is capable of providing cigarette rods from two separate blends of filler material. In particular, an apparatus having two feeding mechanisms can be employed in order to provide a continuous rod comprising alternating segments of filler. Such methods of manufacture provide the ability to provide differing filler materials in the respective third and fourth segments. Such methods are believed to provide the ability to manufacture cigarettes at a commercial scale while maintaining strict, definable quality control.

Cigarette rods can be manufactured using the apparatus described in U.S. Pat. No. 4,516,585 to Pinkham, which is incorporated herein by reference. In particular, a variation in the negative pressure zone of the Pinkham apparatus can produce a pocket of filler material of increased packing density. The resulting pocket can be transferred to a perforated belt thus providing continuously alternating zones of filler material each having a low and high packing density. Alternatively, cigarette rods can be manufactured using the apparatus described in U.S. Pat. No. 4,009,722 to Wahle et al, which is incorporated herein by reference. In particular, an increase in the negative pressure associated with the suction wheel of the Wahle apparatus can produce a pocket of filler material having increased packing density. The resulting pocket can be transferred to a transfer station which in turn deposits the pocket of filler material on a perforated belt thus providing essentially equally spaced pockets. Filler material from a second chamber is added to the regions on the belt between the aforementioned pockets. In yet another manner, cigarette rods can be manufactured using the apparatus generally described in U.S. Pat. No. 3,880,171 to Naylor, which is incorporated herein by reference. In particular, the disk knives can be adjusted such that double wedge shapes of filler material are formed rather than the disclosed double wedged portions, thereby providing discrete segments of filler material. For example, trimming disk knives with two grooves therein can act to remove the various segments from the stream of filler material, and the resulting pockets of filler material are of differing depths having a discrete, segmented shape. The peripheral length of each of the pockets can be changed in order to produce pockets of varying widths and depths, which can act to alter the packing density of a particular segment.

The continuous rod is cut to the desired length using a subdividing means such as a cutting knife. The cutting of the rod into the desired lengths can result in one means for providing the first and second segments, wherein each of the segments has an average density which typically differs from (i.e., is less than) the respective adjacent segments by up to about 15 percent. Typically, such first and second segments are referred to as "loose ends." However, if desired, the ends of the rod can be compacted during formation thereof in order to reduce the amount of spillage of filler from the open ends thereof. Compacted rod ends can be provided by employing compression wheels or rotating trimmer disks as are described in U.S. Pat. Nos. 1,920,708 to Molins and 3,604,429 to DeWitt. The compacted ends of so called "dense ends" of the rod typically have average densities up to about 10 percent greater than that of the segment adjacent thereto. The previously described density differential between the third and fourth segments, and the "loose end" or "dense end" configuration of each of the first and second segments, allow the various segments to be defined in terms of their densities.

The rods so provided have wrapping material having a high burn rate capability at least in a substantial region thereof which overlies the third segment, and a low burn rate capability at least in a substantial region thereof which overlies the fourth segment. The burn rate accelerators or suppressants can be applied to the inner surface or outer surface of the wrapping material which covers the rod. The various burn rate capabilities can be provided to the wrapping material in the regions thereof which overlie the various segments using a variety of techniques. For example, solutions of burn rate accelerator or suppressant can be applied to a selected portion of the surface of a manufactured rod using a roller application, a spray technique, printing technique, electrostatic embossing techniques, embedding microcapsules containing the burn rate accelerator or suppressant in the wrapping material, or the like. Alternatively, a convoluted web of wrapping material which is pretreated so as to have sections of burn rate accelerator and/or suppressant thereon; and the web can be transferred through the rod making unit in a timed, predetermined manner such that the particular third or fourth segment of filler material is positioned within the required treated portion of the web.

If desired, the rods can be double wrapped in wrapping material. For example, essentially untreated paper wrap can be wrapped around the previously described rods. Alternatively, a paper treated with burn rate suppressor or accelerator can be wrapped around the previously described rods. In such situations, the underlying first layer of wrapping material which is treated with burn rate suppressors and/or accelerators can be color coded for easy identification of regions to envelope the desired dense and less dense filler segments, respectively.

Another means by which the burn rate capability of the wrapping material can be altered includes changing the basis weight of the wrapping material. For example, the wrapping material can have a relatively low basis weight in the region thereof which envelopes the relatively dense segments, and a relatively high basis weight in the region thereof which evelopes the less dense segments. In addition, the burn rate capability of the wrapping can be altered by changing the porosity or permeability of the wrapping material. For example, the wrapping material can have a relatively high porosity or permeability in the region thereof which envelopes the relatively dense segments, and a relatively low porosity or permeability in the region thereof which envelopes the less dense segments.

The following examples are given to further illustrate the invention but should not be considered as limiting the scope thereof. Unless otherwise noted, all parts and percentages are by weight.

EXAMPLE 1

A sample of tobacco having a relatively low density and high nicotine content is provided. The sample consists essentially of strands of volume expanded, flue cured tobacco cut at 32 cuts per inch and has a nicotine content of 3.25 percent.

A second sample of tobacco having a relatively high density and low nicotine content is provided. The second sample consists essentially of strands of Turkish tobacco cut at 32 cuts per inch and has a nicotine content of 1.02 percent.

Cylindrical cigarette (i.e., tobacco) rods of 60 mm length and 24.8 mm circumference are provided from each of the two aforementioned tobacco samples and conventional air impermeable cigarette paper using an apparatus generally described in U.S. Pat. No. 4,009,722 to Wahle et al. The first and second segments of the tobacco rods so provided are the "loose ends" produced by cutting the continuous rod into 60 mm lengths and not using a trimmer disk for "dense end" purposes. The rods so manufactured have first and third segments provided from the high density sample. The first and third segments have combined longitudinally extending lengths of 30 mm. The second and fourth segments of the manufactured rods are provided from the low density sample. The second and fourth segments have combined longitudinally extending lengths of 30 mm. The first segment extends about 2 mm to about 5 mm longitudinally along the rod and exhibits an average density of about 10 to about 15 percent less than the adjacent third segment. The second segment extends about 2 mm to about 5 mm longitudinally along the rod and exhibits an average density of about 10 to about 15 percent less than the adjacent fourth segment.

The actual density differential between the combined first and third segments and the combined second and fourth segments is about −110.6. The density differential is believed to be provided by the combined effects of the varying packing densities of the segments and the varying densities of the blends used in forming the segments.

Filter plugs having lengths of 24 mm and diameters of 24.8 mm are provided. The filter plugs include a cylindrical cellulose acetate element circumscribed by an air permeable paper plug wrap. Each filter plug is aligned with each tobacco rod in an abutting end-to-end relation such that the plug is adjacent the second segment of the rod. The filter plug is attached to the rod with circumscribing micromechanical perforated tipping paper such that the resulting filter cigarette exhibits 28 percent air dilution.

The resulting (i.e., so called "untreated") filter cigarette is treated with burn rate suppressant. An aqueous solution of starch is applied as a coating using a small paint brush to the cigarette paper wrap in the region thereof which envelopes the second and fourth segments (i.e., which extends 30 mm along the length of the tobacco rod). The starch solution consists essentially of about 1 g of starch in 50 ml of distilled water. The starch solution is applied 4 times to the paper wrap, and the cigarette is allowed to dry after each application. About 2.3 mg of starch is applied to the cigarette (the amount of burn rate suppressant over second and fourth segments is about 11 percent, based on the total weight of the paper covering those 2 segments). The cigarette is conditioned at 24° C. and 60 percent relative humidity for 1 week. The cigarette is designated as Sample No. 1.

For comparison purposes, an untreated filter cigarette as described hereinbefore has distilled water applied to the surface of the cigarette paper wrap in a manner similar to the manner in which the starch solution is applied to Sample No. 1. The cigarette then is conditioned at 24° C. and 60 percent relative humidity for 1 week. The cigarette is designated as Sample No. C-1.

The puff-by-puff profiles of "tar" and nicotine for Sample Nos. 1 and C-1 are provided using a smoking machine and modules. The smoking machine and modules required for puff-by-puff analysis are similar to an apparatus commercially available from Heinr. Borgwaldt GmbH, Hamburg, West Germany. In this manner smoke delivery profiles for the various samples are provided. As used herein the term "smoke delivery profile" in referring to a cigarette means the profile of provided, collected and analyzed smoke components, on a puff-by-puff basis when the cigarette is smoked under standard FTC (i.e., U.S. Federal Trade Commission) conditions.

Data are presented in Table I.

TABLE I

| | Sample No. 1 | | Sample No. C-1* | |
|---|---|---|---|---|
| Puff No. | Nicotine (mg) | 'Tar' (mg) | Nicotine (mg) | 'Tar' (mg) |
| 1 | 0.131 | 1.53 | 0.132 | 1.40 |
| 2 | 0.222 | 2.08 | 0.218 | 1.95 |
| 3 | 0.256 | 2.43 | 0.257 | 2.38 |
| 4 | 0.278 | 2.78 | 0.213 | 2.25 |
| 5 | 0.298 | 2.89 | 0.149 | 1.25 |
| 6 | 0.190 | 2.13 | 0.110 | 1.45 |
| 7 | 0.120 | 1.50 | 0.105 | 1.55 |
| 8 | 0.123 | 1.58 | 0.103 | 1.53 |
| 9 | 0.120 | 1.63 | 0.109 | 1.67 |
| 10 | 0.109 | 1.62 | — | — |
| 11 | 0.105 | 1.58 | — | — |

*not an example of the invention.

The data in Table I indicate that the puff-by-puff deliveries of delivered "tar" and nicotine are relatively high over an extended portion of the cigarette (i.e., through Puff Nos. 4-6) relative to the untreated, comparative Sample No. C-1. Sample No. 1 has an increased puff count over, and a more uniform linear burn rate than Sample No. C-1.

EXAMPLE 2

Untreated filter cigarettes described in Example 1 are provided.

As untreated filter cigarette is treated with a burn rate suppressant. An aqueous solution of pectin is applied using a small paint brush to the region thereof which envelopes the second and fourth segments (i.e., which extend 30 mm along the length of the tobacco rod). The pectin solution consists essentially of about 1 g of pectin in 50 ml of distilled water. The pectin solution is applied by one application to the paper wrap, and the cigarette is allowed to dry after the application. About 0.8 mg of pectin is applied to the cigarette (the amount of burn rate suppressant over second and fourth segments is about 4 percent, based on the total weight of the paper covering those 2 segments). The cigarette is conditioned at 24° C. and 60 percent relative humidity for 1 week. The cigarette is designated as Sample No. 2.

For comparison purposes, an untreated filter cigarette as described in Example 1 has distilled water applied to the surface of the cigarette paper wrap in a manner similar to the manner in which the pectin solution is applied to Sample No. 2. The cigarette then is conditioned at 24° C. and 60 percent relative humidity for 1 week. The cigarette is designated as Sample No. C-2.

The puff-by-puff profiles of "tar" and nicotine for Sample Nos. 2 and C-2 are provided as described in Example 1. Data are presented in Table II.

TABLE II

| | Sample No. 2 | | Sample No. C-2* | |
|---|---|---|---|---|
| Puff No. | Nicotine (mg) | 'Tar' (mg) | Nicotine (mg) | 'Tar' (mg) |
| 1 | 0.132 | 1.41 | 0.144 | 1.47 |
| 2 | 0.211 | 1.94 | 0.229 | 1.99 |
| 3 | 0.267 | 2.51 | 0.249 | 2.23 |
| 4 | 0.303 | 2.78 | 0.222 | 2.29 |
| 5 | 0.270 | 2.68 | 0.155 | 1.95 |
| 6 | 0.182 | 2.04 | 0.107 | 1.51 |
| 7 | 0.119 | 1.47 | 0.111 | 1.65 |
| 8 | 0.112 | 1.55 | 0.098 | 1.60 |
| 9 | 0.111 | 1.66 | 0.094 | 1.59 |
| 10 | 0.096 | 1.49 | — | — |
| 11 | 0.105 | 1.58 | — | — |

*not an example of the invention.

The data in Table II indicate that the puff-by-puff deliveries of delivered "tar" and nicotine are relatively high over an extended portion of the cigarette (i.e., through Puff Nos. 4-6) relative to the untreated, comparative Sample No. C-2. Sample No. 2 has an increased puff count over, and a more linear burn rate than Sample No. C-2.

EXAMPLE 3

Untreated filter cigarettes described in Example 1 are provided.

An untreated filter cigarette is treated with a burn rate suppressant over the second and fourth segments, and with a burn rate accelerator over the first and third segments. An aqueous solution of pectin is applied using a small paint brush to the region thereof which envelopes the second and fourth segments (i.e., which extend 30 mm along the length of the tobacco rod). The pectin solution consists essentially of about 1 g of pectin in 50 ml of distilled water. The pectin solution is applied by one application to the paper wrap, and the cigarette is allowed to dry after the application. About 1.6 mg of pectin is applied to the cigarette (the amount of burn rate suppressant over second and fourth segments is about 8 percent, based on the total weight of the paper covering those 2 segments). An aqueous solution of potassium citrate is applied using a small paint brush to the region thereof which envelopes the first and third segments (i.e., which extend 30 mm along the length of the tobacco rod). The citrate solution consists essentially of 2.3 g of potassium citrate in 50 ml of distilled water. The citrate solution is applied by one application to the paper wrap, and the cigarette is allowed to dry after the application. About 0.5 mg of potassium citrate is applied to the cigarette (percent of burn rate accelerator over first and second segments is about 2.5 percent, based on the total weight of the paper covering those 2 segments). The resulting cigarette is conditioned at 24° C. and 60 percent relative humidity for 1 week. The cigarette is designated as Sample No. 3.

For comparison purposes, an untreated filter cigarette as described in Example 1 has distilled water applied to the surface of the cigarette paper wrap in a manner similar to the manner in which the solutions are applied to Sample No. 3. The cigarette then is conditioned at 24° C. and 60 percent relative humidity for 1 week. The cigarette is designated as Sample No. C-3.

The puff-by-puff profiles of "tar" and nicotine for Sample Nos. 3 and C-3 are provided as described in Example 1. Data are presented in Table III.

TABLE III

| | Sample No. 3 | | Sample No. C-3* | |
|---|---|---|---|---|
| Puff No. | Nicotine (mg) | 'Tar' (mg) | Nicotine (mg) | 'Tar' (mg) |
| 1 | 0.131 | 1.30 | 0.062 | 0.71 |
| 2 | 0.222 | 2.02 | 0.216 | 1.94 |
| 3 | 0.281 | 2.52 | 0.238 | 2.22 |
| 4 | 0.301 | 2.73 | 0.219 | 2.18 |
| 5 | 0.236 | 2.45 | 0.153 | 1.95 |
| 6 | 0.155 | 1.94 | 0.118 | 1.67 |
| 7 | 0.133 | 1.84 | 0.099 | 1.54 |
| 8 | 0.125 | 1.86 | 0.104 | 1.64 |
| 9 | 0.123 | 1.99 | 0.096 | 1.64 |

*not an example of the invention.

The data in Table III indicate that the puff-by-puff deliveries of delivered "tar" and nicotine are relatively high over an extended portion of the cigarette (i.e., through Puff Nos. 4–6) relative to the untreated, comparative Sample No. C-3. Sample No. 3 has a more linear burn rate than Sample No. C-3.

What is claimed is:

1. A rod suitable for the manufacture of a cigarette, said rod comprising filler material contained in wrapping material and having the two ends thereof open to expose the filler material, wherein (A) said filler material forms at least four segments within said rod and each segment is defined by its density, wherein (i) the first segment is disposed at the extreme end of the rod which is to be lit;

(ii) the second segment is disposed at the end of the rod opposite the end which is to be lit;

(iii) the third segment is disposed adjacent to the first segment; and (iv) the fourth segment is disposed adjacent to the second segment;

wherein each of the third segment and the fourth segment has a substantially uniform density in the region along the longitudinal axis of the rod and across the rod in a plane perpendicular to the longitudinal axis thereof, and the density of the fourth segment is less than that of the third segment such that the density differential therebetween is at least about 15 percent; and (B) said wrapping material has (i) a relatively high burn rate capability at least in a substantial region thereof which overlies the third segment, and (ii) a relatively low burn rate capability at least in a substantial region thereof which overlies the fourth segment.

2. The rod of claim 1 wherein said filler material is smokable material.

3. The rod of claim 2 wherein the relative nicotine content of the third segment is greater than that of the fourth segment.

4. The rod of claim 2 wherein the relative nicotine content of the third segment is less than that of the fourth segment.

5. The rod of claim 2 wherein each of the four segments have essentially equal relative nicotine contents.

6. The rod of claim 2 wherein the smokable material of each segment is a blend of smokable materials.

7. The rod of claim 6 wherein the blend of smokable materials is a blend of tobaccos.

8. The rod of claim 6 wherein the blend of filler materials of the first and third segments is the same as the blend of filler materials of the second and fourth segments.

9. The rod of claim 6 wherein the blend of filler materials of the first and third segments is different from the blend of filler materials of the second and fourth segments.

10. The rod of claim 2 wherein the smokable material of the second and fourth segments is the volume expanded form of the smokable material of the first and third segments.

11. The rod of claim 2 wherein the smokable material of the first and third segments is volume expanded.

12. The rod of claim 2 wherein the smokable material of the second and fourth segments is volume expanded.

13. The rod of claim 2 wherein the high burn rate capability is provided by a burn rate accelerator.

14. The rod of claim 13 wherein the burn rate accelerator is applied to the wrapping material and extends (i) totally around the periphery of the rod, and (ii) along the length of the rod in the region which overlies the first and third segments.

15. The rod of claim 14 having two layers of wrapping material.

16. The rod of claim 15 wherein the outer layer of wrapping material is essentially untreated with burn rate accelerator or suppressant.

17. The rod of claim 13 wherein the burn rate accelerator is potassium citrate.

18. The rod of claim 2 wherein the low burn rate capability is provided by a burn rate suppressant.

19. The rod of claim 18 wherein the burn rate suppressant is applied to the wrapping material and extends (i) totally around the periphery of the rod, and (ii) along the length of the rod in the region which overlies the second and fourth segments.

20. The rod of claim 19 having two layers of wrapping material.

21. The rod of claim 20 wherein the outer layer of wrapping material is essentially untreated with burn rate accelerator or suppressant.

22. The rod of claim 2 wherein the high burn rate capability is provided by a burn rate accelerator, and the low burn rate capability is provided by a burn rate suppressant.

23. The rod of claim 29 wherein the burn rate accelerator is applied to the wrapping material and extends (i) totally around the periphery of the rod, and (ii) along the length of the rod in the region which overlies the first and third segments; and the burn rate suppressant is applied to the wrapping material and extends (i) totally around the periphery of the rod, and (ii) along the length of the rod in the region which overlies the second and fourth segments.

24. The rod of claim 23 having two layers of wrapping material.

25. The rod of claim 24 wherein the outer layer of wrapping material is essentially untreated with burn rate accelerator or suppressant.

26. The rod of claim 2 having two layers of wrapping material.

27. The rod of claim 1 wherein the first segment and the second segment each have a density greater than the segment adjacent to each of the respective first and second segments.

28. The rod of claim 3 wherein the combined longitudinal length of the second segment and the fourth segment extend from about 20 to about 80 percent of the total length of the rod.

29. The rod of claim 27 wherein the combined longitudinal length of the second segment and the fourth segment extend from about 30 to about 70 percent of the total length of the rod.

30. The rod of claim 1 wherein the first segment and the second segment each have a density less than the segment adjacent to each of the respective first and second segments.

31. The rod of claim 30 wherein the combined longitudinal length of the second segment and the fourth segment extend from about 20 to about 80 percent of the total length of the rod.

32. The rod of claim 30 wherein the combined longitudinal length of the second segment and the fourth segment extends from about 30 to about 70 percent of the total length of the rod.

33. The rod of claim 1 wherein the first segment has a density less than the third segment and the second segment has a density greater than the fourth segment.

34. The rod of claim 1 wherein the first segment has a density greater than the third segment and the second segment has a density less than the fourth segment.

35. The rod of claim 1 wherein the density differential is between about 20 percent and about 270 percent.

36. The rod of claim 1 wherein the density differential is between about 30 percent and about 130 percent.

37. A filter cigarette comprising the rod of claim 1 and an attached filter plug axially aligned therewith at the end of the rod adjacent to the second segment thereof.

38. A filter cigarette comprising the rod of claim 1 and an attached filter plug axially aligned therewith at the end of the rod adjacent to the first segment thereof.

* * * * *